United States Patent [19]

Jalali et al.

[11] 4,418,917

[45] Dec. 6, 1983

[54] ELECTRONIC TARGET GAME

[75] Inventors: Bijan Jalali, Huntington Beach; Luan G. Tran, Redondo Beach, both of Calif.

[73] Assignee: Mattel, Inc., Hawthorne, Calif.

[21] Appl. No.: 220,623

[22] Filed: Dec. 29, 1980

[51] Int. Cl.[3] ..... A63F 9/02

[52] U.S. Cl. ..... 273/313; 273/1 G C; 273/85 G

[58] Field of Search ..... 273/1 GC, 1 E, 85 G, 273/313, DIG. 28, 138 A; 340/323 R; 364/410-411

[56] References Cited

U.S. PATENT DOCUMENTS

| | | | |
|---|---|---|---|
| 3,874,669 | 4/1975 | Ariano et al. | 273/85 G |
| 4,026,555 | 5/1977 | Kirschner et al. | 273/85 G |
| 4,060,242 | 11/1977 | Huang et al. | 273/1 GC |
| 4,093,221 | 6/1978 | Dash | 273/85 G |
| 4,095,785 | 6/1978 | Conner | 273/1 GC |
| 4,169,592 | 10/1979 | Hall | 273/1 GC |
| 4,185,825 | 1/1980 | Bromley | 273/313 |
| 4,322,073 | 5/1982 | Slavik et al. | 273/1 GC |

OTHER PUBLICATIONS

*Popular Electronics*; Mar. 1977; pp. 77-79, 84,85.
*Popular Electronics*; Jun. 1977; pp. 50-52.
*Electronics Today International*; Apr. 1979; pp. 61-67.

*Primary Examiner*—Vance Y. Hum
*Attorney, Agent, or Firm*—Reagin & King

[57] ABSTRACT

A portable electronic target game is disclosed, including a playing field display, scoring displays and two sets of input keys to permit two players to simultaneously control the operation of the game. Each player may launch a projectile toward a moving ball in an effort to intercept it, causing the ball to move forward the opposing player. The ball is removed from play if it is captured by a player or if it lands in a pocket location on the playing field. The scoring includes bonus points and penalties for the various events. The motion of the ball is controlled in a pseudorandom manner in accordance with a predetermined probability matrix.

7 Claims, 16 Drawing Figures

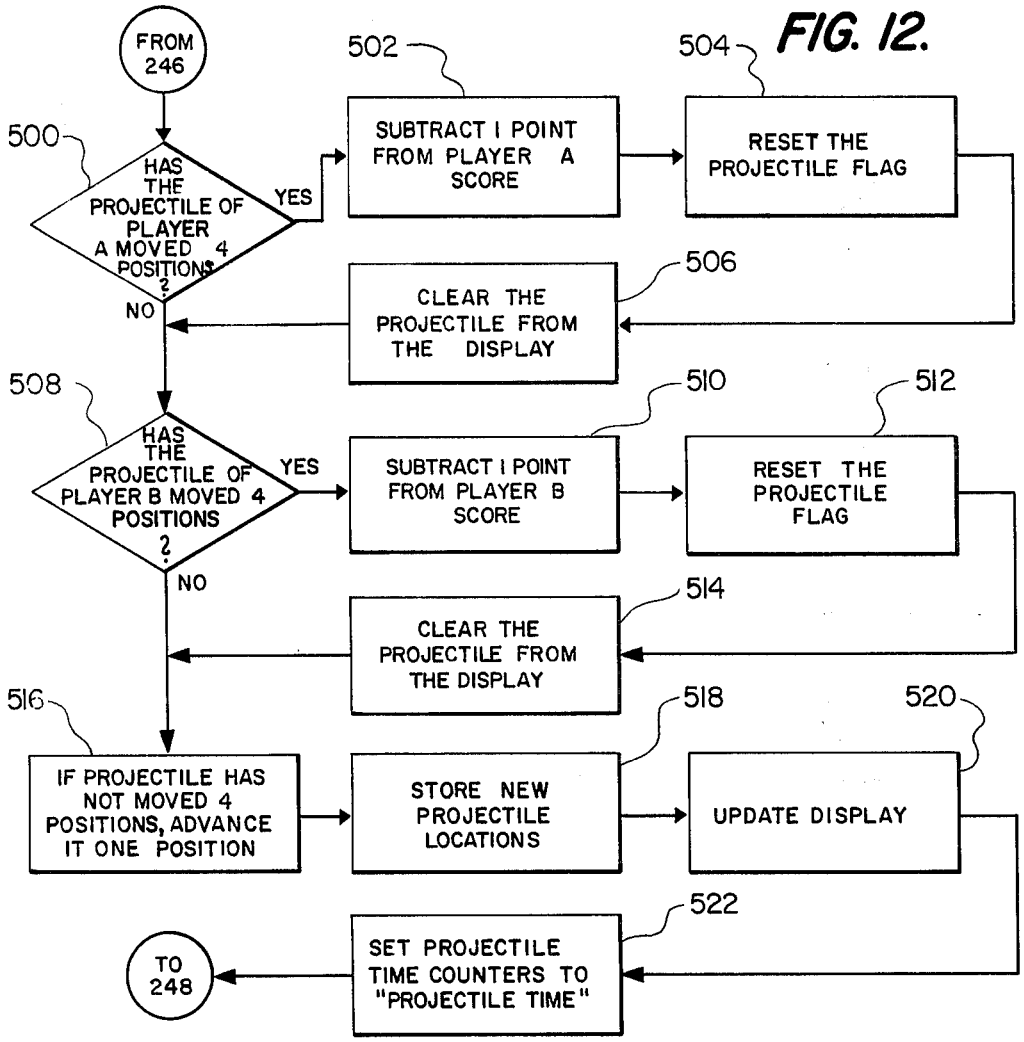
FIG. 12.
FROM 246
500
HAS THE PROJECTILE OF PLAYER A MOVED 4 POSITIONS ?
YES
NO
502
SUBTRACT 1 POINT FROM PLAYER A SCORE
504
RESET THE PROJECTILE FLAG
506
CLEAR THE PROJECTILE FROM THE DISPLAY
508
HAS THE PROJECTILE OF PLAYER B MOVED 4 POSITIONS ?
YES
NO
510
SUBTRACT 1 POINT FROM PLAYER B SCORE
512
RESET THE PROJECTILE FLAG
514
CLEAR THE PROJECTILE FROM THE DISPLAY
516
IF PROJECTILE HAS NOT MOVED 4 POSITIONS, ADVANCE IT ONE POSITION
518
STORE NEW PROJECTILE LOCATIONS
520
UPDATE DISPLAY
522
SET PROJECTILE TIME COUNTERS TO "PROJECTILE TIME"
TO 248

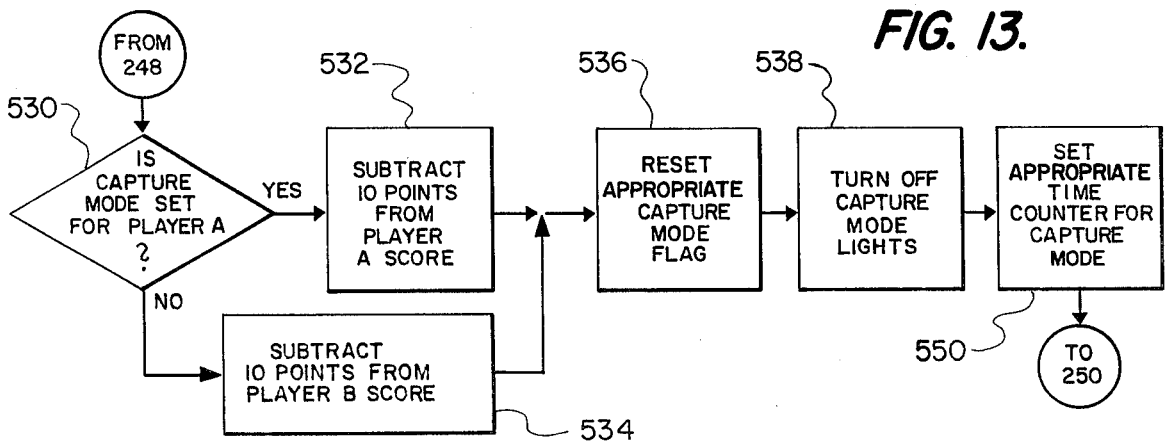
FIG. 13.
FROM 248
530
IS CAPTURE MODE SET FOR PLAYER A ?
YES
NO
532
SUBTRACT 10 POINTS FROM PLAYER A SCORE
534
SUBTRACT 10 POINTS FROM PLAYER B SCORE
536
RESET APPROPRIATE CAPTURE MODE FLAG
538
TURN OFF CAPTURE MODE LIGHTS
550
SET APPROPRIATE TIME COUNTER FOR CAPTURE MODE
TO 250

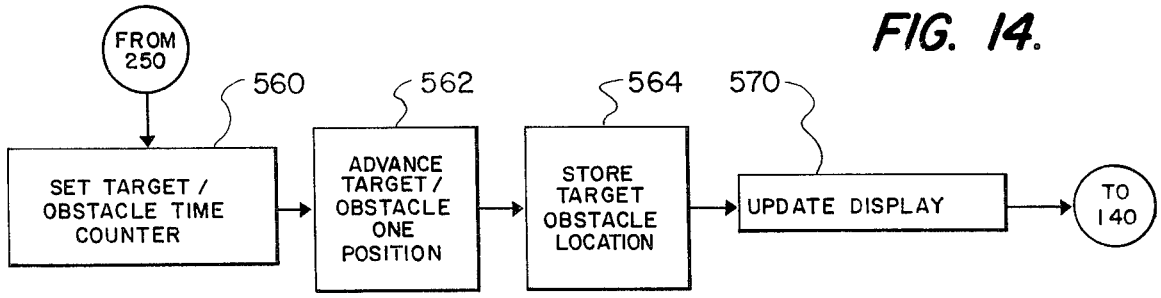
FIG. 14.
FROM 250
560
SET TARGET / OBSTACLE TIME COUNTER
562
ADVANCE TARGET / OBSTACLE ONE POSITION
564
STORE TARGET OBSTACLE LOCATION
570
UPDATE DISPLAY
TO 140

PRESENT LOCATION OF THE BALL

| TABLE INDEX | 50 | 52 | 54 | 56 | 58 | 60 | 62 | 64 | 66 | 68 | 70 | 72 | 74 | 76 | 78 | 80 | 82 | 84 | 86 |
|---|---|---|---|---|---|---|---|---|---|---|---|---|---|---|---|---|---|---|---|
| 1 | 50 | 54 | 56 | 56 | 60 | 62 | 62 | 64 | 68 | 70 | 70 | 74 | 76 | 76 | 72 | 72 | 74 | 74 | 76 |
| 2 | 50 | 52 | 52 | 54 | 58 | 58 | 60 | 64 | 66 | 66 | 68 | 72 | 72 | 74 | 72 | 74 | 74 | 76 | 76 |
| 3 | 50 | 54 | 56 | 56 | 60 | 62 | 62 | 64 | 68 | 70 | 70 | 74 | 76 | 76 | 80 | 82 | 84 | 86 | 86 |
| 4 | 50 | 50 | 50 | 50 | 52 | 54 | 56 | 64 | 72 | 74 | 76 | 80 | 82 | 84 | 58 | 58 | 60 | 60 | 62 |
| 5 | 50 | 52 | 52 | 54 | 58 | 58 | 60 | 64 | 66 | 66 | 68 | 72 | 72 | 74 | 58 | 60 | 60 | 62 | 62 |
| 6 | 50 | 54 | 56 | 56 | 60 | 62 | 62 | 64 | 68 | 70 | 70 | 74 | 76 | 76 | 58 | 60 | 60 | 62 | 62 |
| 7 | 50 | 52 | 52 | 54 | 58 | 58 | 60 | 64 | 66 | 66 | 68 | 72 | 72 | 74 | 78 | 78 | 80 | 82 | 84 |
| 8 | 50 | 58 | 60 | 62 | 80 | 82 | 84 | 64 | 64 | 64 | 64 | 66 | 68 | 70 | 72 | 74 | 74 | 76 | 76 |

*FIG. 15. A.*

*FIG. 15. B.*

| PRESENT LOCATION | LOCATION OF NEXT MOVE | | PROBABILITY OF THE MOVE |
|---|---|---|---|
| | BALL DIRECTION = UP | BALL DIRECTION = DOWN | |
| 50, 64 | NO MOVE | NO MOVE | 100 % |
| 54, 60, 68, 74 | UP | DOWN | 20 % |
| | LEFT | LEFT | 40 % |
| | RIGHT | RIGHT | 40 % |
| 52, 58, 66, 72 | NO MOVE | NO MOVE | 40 % |
| | RIGHT | RIGHT | 40 % |
| | UP | DOWN | 20 % |
| 56, 62, 70, 76 | NO MOVE | NO MOVE | 40 % |
| | LEFT | LEFT | 40 % |
| | UP | DOWN | 20 % |
| 78 | RIGHT | RIGHT | 20 % |
| | UP | DOWN | 60 % |
| | NO MOVE | NO MOVE | 20 % |
| 86 | LEFT | LEFT | 20 % |
| | UP | DOWN | 60 % |
| | NO MOVE | NO MOVE | 20 % |
| 80, 82, 84 | LEFT | LEFT | 20 % |
| | RIGHT | RIGHT | 20 % |
| | UP TO LEFT | DOWN TO LEFT | 20 % |
| | UP TO RIGHT | DOWN TO RIGHT | 40 % |

ELECTRONIC TARGET GAME

BACKGROUND OF THE INVENTION

This invention relates to games and, more particularly, to electronic games for simulating the play of pinball machines.

A variety of arcade games generally known as pinball machines have been in use for many years. These pinball machines generally consists of a large glass enclosed horizontal playing surface supported on legs. These machines also include a vertical upstanding section used to display the scores. Typical game play involves the player launching a ball onto the playing surface by means of a spring loaded mechanical plunger. The ball is then diverted by a series of bumpers and flappers. The object of the game is to maximize the scores by keeping the ball on the playing surface as long as possible by preventing it from falling into a pocket. The playing surface usually has certain areas designated to increase score and thus a second object is to maneuver the ball into these designated high scoring areas. The game ends when a fixed number of balls have been played.

There are also versions of the pinball machine that permit two or more players to alternate turns, playing in sequence. Each player pits his skill against the machine and individual scores are tallied. The player achieving the highest score is the winner.

Early pinball machines were constructed with mechanical linkages and mechanisms to control ball motion and scoring. More recently, pinball machines have been constructed which employ electronics for scoring and control of ball deflection.

Although the prior art pinball machines have gained widespread use, they possess several disadvantages. Their large size precludes their use as a portable game and also results in a very expensive machine. In addition, most prior art pinball machines do not permit two players to play against each other simultaneously.

Accordingly, it is an object of this invention to provide a new and improved pinball game.

It is another object of this invention to provide a new and improved portable electronic pinball game.

It is still another object of this invention to provide an electronic pinball game operable by two players simultaneously.

SUMMARY OF THE INVENTION

The foregoing and other objects of the invention are accomplished by a portable electronic pinball game which has an exterior housing mounting a display on which indications representing the various obstacles, the ball and the scoring results are represented. The housing also mounts two sets of input keys on opposite sides of the housing to permit two players to control the operation of the game, and also contains electronic data processing circuitry organized to provide the automatic play of pinball at a number of different skill levels.

The display consists of a diamond shaped playing field containing a plurality of multi-colored lights. The playing field is divided into two equal sides, one side adjacent each player. Each side contains lights of a different color, such as red and green. These lights are used to represent the positions of a ball and of projectiles as described below. Across the center of the display, dividing the two sides, is a line of yellow lights designed to represent a moving target or ball at the beginning of each game. The movement of the ball is accomplished by alternately illuminating the yellow lights in a time sequence. The game play begins as each player depresses a key to launch a projectile toward the moving ball in an effort to hit it. A projectile is represented by sequentially illuminating a line of lights to simulate motions, beginning with a position closest to the player and moving toward the center of the field. An object of the game is to hit the ball with a projectile causing the ball to move toward the side of the opposing player. After a ball has been hit and moves from the central target line into a player's side of the field, the central line of yellow lights changes modes and begins representing a moving obstacle as opposed to a moving target. During subsequent play, the ball may be intercepted by this moving obstacle as the ball crosses the central dividing line. If intercepted, the direction of the ball is reversed and the ball begins moving back in the direction from which it came.

There are two circumstances in which the play of a ball is ended. Play ends if a ball reaches one of two designated locations positioned on each side of the playing field away from the center dividing line and representing pockets. It is an object of the game to prevent the ball from reaching the player's own pocket by intercepting the ball with projectiles. If a ball reaches a pocket, it is removed from play (lost) and a new ball appears as a moving target along the center line.

The second circumstance in which the play of a ball ends is when a player captures the ball by passing a specified key when the ball is at a designated capture location on the field. If a ball is captured, it is removed from play; and a new ball appears as a moving target along the center line.

Each player accumulates scoring points during the play of the game. A player's score may be increased or decreased in response to the location of the ball and the player's actions. In accordance with a prescribed scoring routine, certain events result in bonus points while other events result in scoring penalties. A variety of sounds are also provided to signify events as they occur. The game ends and the final scores are displayed when a predetermined number of balls have been played. The players may select from a variety of skill levels which effectively determine the speed of the ball and the projectiles.

Other objects, features and advantages of the invention will become apparent by reference to the specification taken in conjunction with the drawings from which like elements are referred to by like reference designations throughout the several views.

DESCRIPTION OF THE DRAWINGS

FIGS. 4–15B are flow charts showing the program and operation of the preferred embodiment of the present invention.

DESCRIPTION OF THE PREFERRED EMBODIMENT

Figure 1:
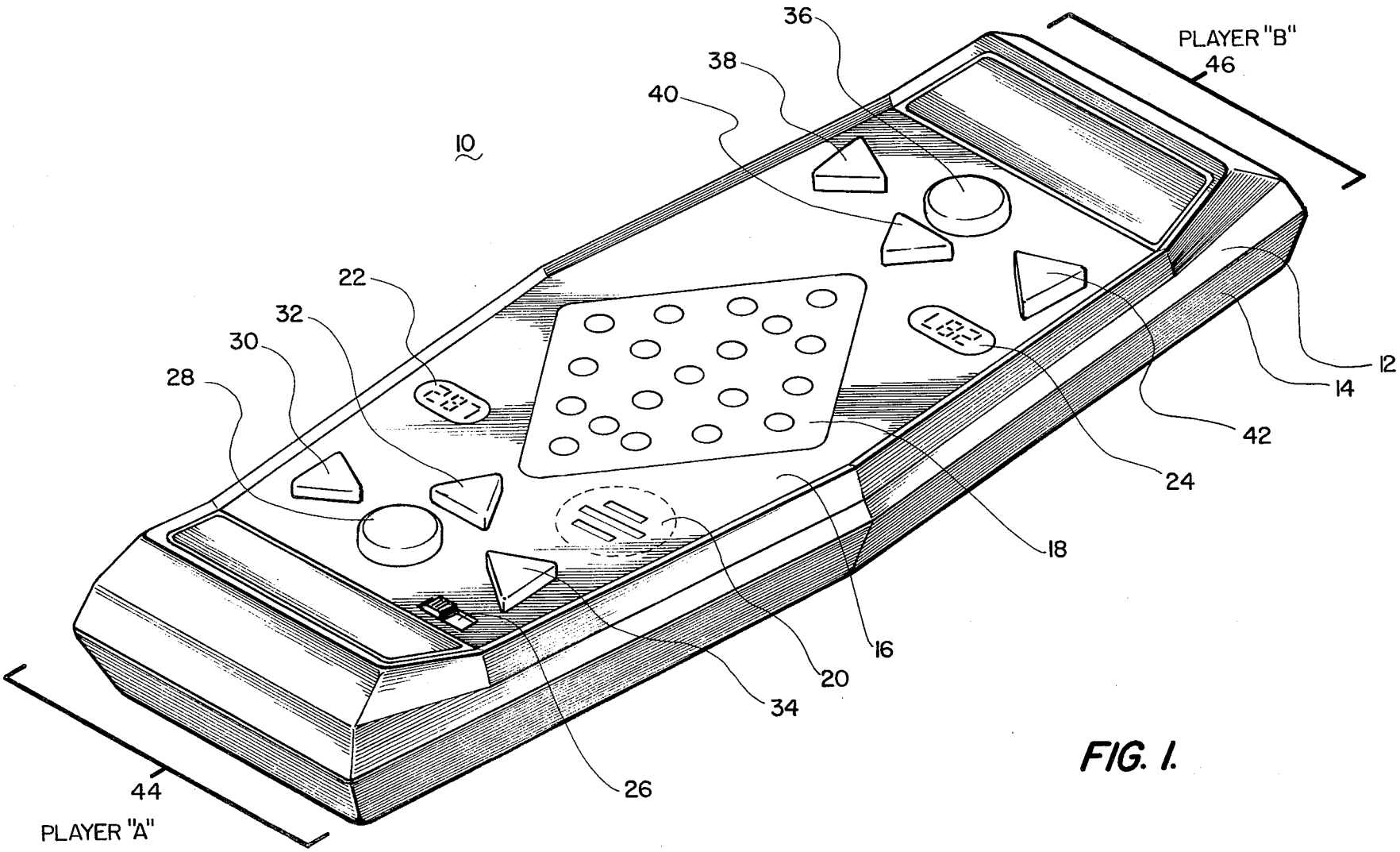
FIG. 1 is a perspective view of the exterior housing of an electronic pinball game constructed in accordance with the invention.

Referring to FIG. 1 there is shown a perspective view of an electronic pinball game 10 constructed in accordance with the invention. The game 10 includes an upper housing 12 and a lower housing 14 each of which may be constructed of a moldable plastic material. The housings 12 and 14 may be joined together in a conventional manner to form a hollow interior for containing electronic components. The upper housing 12 mounts a control panel 16 which includes a playing field display 18, a speaker 20, scoring displays 22 and 24, power switch 26, and keys 28, 30, 32, 34, 36, 38, 40 and 42. On the bottom of the lower housing 14, but not shown in FIG. 1, is a door for providing access for insertion of conventional batteries such as a nine volt transistor battery to operate the circuitry contained within the housing halves 12 and 14 of the game 10.

In the play of the game, two players operate individual controls simultaneously from opposite ends of the display 18. Thus, for example, player A may operate the game 10 from an end shown generally as 44 in FIG. 1; and player B may operate the game from an end 46 of the game 10.

Figure 2:
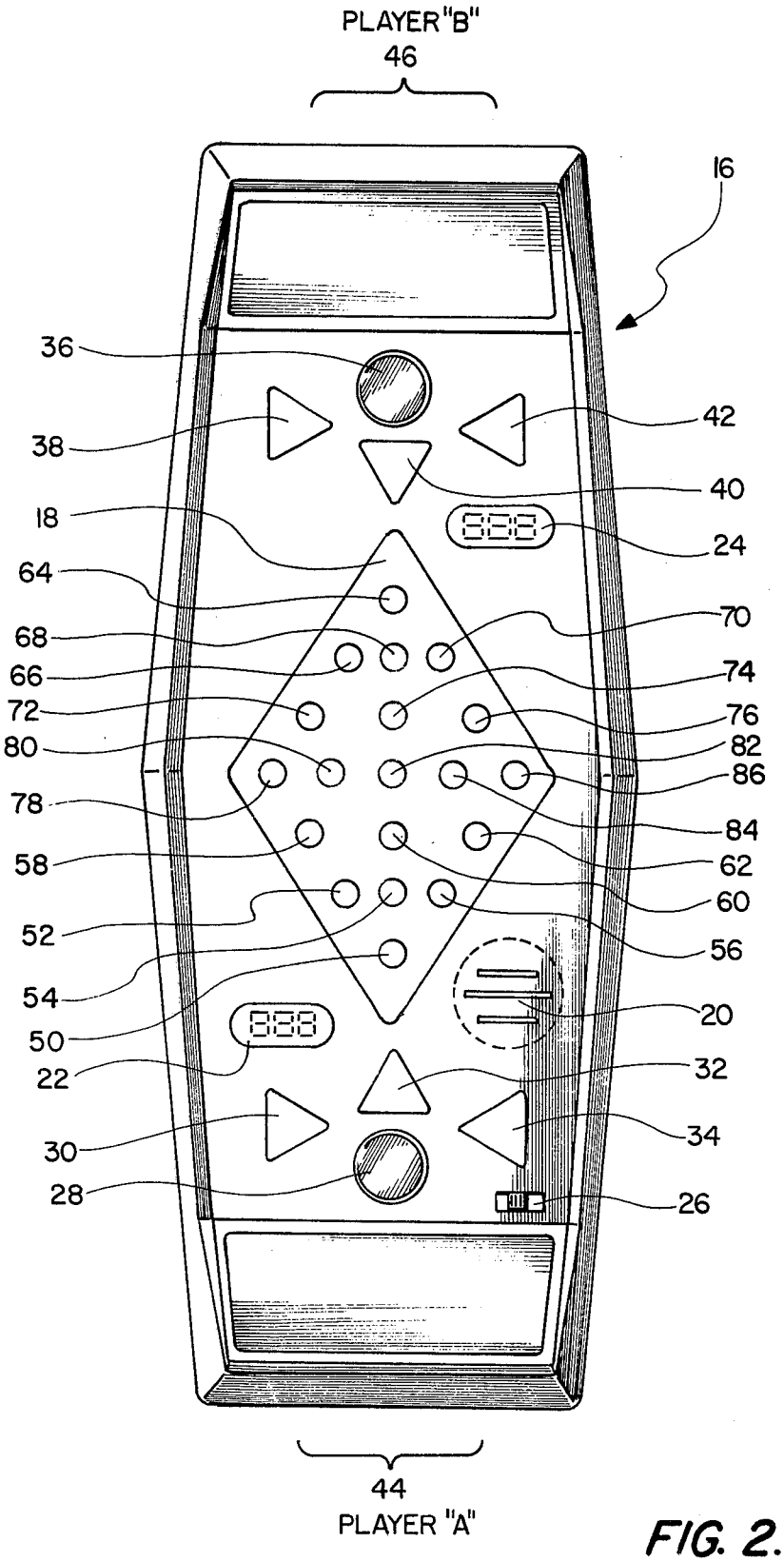
FIG. 2 is a top view of the display of the game illustrated in FIG. 1.

As shown in FIG. 2, the playing field 18 consists of nineteen discrete lights representing a number of locations 50, 52, 54, 56, 58, 60, 62, 64, 66, 68, 70, 72, 74, 76, 78, 80, 82, 84 and 86. The playing field 18 is divided into two sides corresponding to the ends used by players A and B. Thus player A's side of the field consists of the seven locations 50, 52, 54, 56, 58, 60, and 62. Similarly, player B's side of the display consists of the seven locations 64, 66, 68, 70, 72, 74 and 76. The two sides of the playing field 18 are centrally divided by a line of lights representing the five locations 78, 80, 82, 84 and 86. As described hereinafter, these center locations 78, 80, 82, 84 and 86 may represent a moving target or a moving obstacle at various times during the play of the game. In the preferred embodiment, the lights representing the player A locations 50, 52, 54, 56, 58, 60 and 62 are differentiated from the lights representing the player B locations 64, 66, 68, 70, 72, 74 and 76 by using different colors. Thus locations 50, 52, 54, 56, 58, 60 and 62 may be represented by red lights, locations 64, 66, 68, 70, 72, 74 and 76 may be represented by green lights, and the center locations 78, 80, 82, 84 and 86 may be represented by yellow lights. The lights on display 18 are typically implemented with light emitting diodes. The scoring displays 22 and 24 may be three-digit, seven-segment displays such as are used in calculators and are well known by those skilled in the art. The display 22 is used to indicate the score for player A, and the display 24 is used to indicate the score for player B.

To start the game, one of the players, A or B, places the on/off switch 26 in the on position energizing the game 10. The numeric displays 22 and 24 show the symbol SP1 which represents the lowest skill level of the game 10. The skill level represents the rate at which the ball and projectiles move across the display during game play as described hereinafter. The skill level of the game may be changed by either player depressing an appropriate key as follows. Player A pressing key 32 or player B depressing key 40 causes both of the displays 22 and 24 to sequence from the lowest skill level SP1 through the five levels of difficulty in the game to the highest skill level SP5. The displays 22 and 24 will continue to sequence from SP1 to SP5 returning to SP1 until the depressed one of keys 32 and 40 has been released. The skill level shown by the displays 22 and 24 represents the level chosen for the game.

Game play may now be initiated by player A or player B depressing key 28 or 36 respectively. This action blanks the numeric displays 22 and 24 and causes the central row of yellow LEDs to begin flashing in a continuous sequence, one location at a time from location 78 to location 86 and then returning from location 86 back to location 78. The LEDs thus appear as a moving sequence of lights with only one LED being lit at any time.

At this point the game is in a first mode (designated the target mode) with the sequence of flashing yellow LEDs across the center of the playing field 18 representing a moving ball. To continue game play, the ball must be dislodged from the positions 78, 80, 82, 84 and 86. This is accomplished by either player launching a projectile toward the center of the field 18 and hitting the ball and thereby dislodging it from the central row. Each player has control of projectiles which may travel in a straight line from a point on the field 18 closest to the player along any of three paths to the center of the field. The moving projectiles are represented by a sequence of flashing lights which proceed along the selected line of fire. A projectile is launched when the player depresses an appropriate key. For example, if player A depresses key 30, a projectile is launched along the left side of the playing field 18 from location 50 to location 78. This is shown as a sequence of flashing red lights at locations 50, 52, 58 and 78. By depressing key 32, a projectile is launched along the center of the field 18 as indicated by lights at locations 50, 54, 60, and 82 flashing in sequence. Similarly, by depressing key 34, a projectile is launched along the right side of the field 18 progressing from location 50 to location 86 as shown by lights 50, 56, 62 and 86 flashing in sequence. The rate at which the lights flash, representing the speed of the projectile, is a function of the skill level selected at the beginning of the game with higher skill levels resulting in projectiles moving at a higher rate. As described hereinafter, the electronic data processing circuitry of the game 10 is configured so that a player may fire a projectile along only one path at a time.

In a similar manner, player B may also launch projectiles along three similar paths. Thus, by depressing key 38 a projectile is launched from position 64 to position 78; by depressing key 40 a projectile is launched from position 64 to position 82; and, finally, by depressing key 42 a projectile is launched from position 64 to position 86. At this point in the game play the object of firing a projectile is to intercept the ball and dislodge it from the central row 78, 80, 82, 84 and 86. An interception is accomplished by firing a projectile at the proper time along the proper path so that the projectile arrives at a location on the central row which coincides with the location of the ball. Accordingly, if player A depresses the key 30 and fires a projectile from location 50 to location 78 and if the projectile arrives at the location 78 when the moving ball is at that location, the projectile dislodges the ball. Since players A and B may fire a projectile simultaneously, either player may dislodge the ball.

Dislodging the ball has the effect of moving it into the opposing player's side of the field. During the game, the ball may only move one step at a time from one location on the field 18 to an adjacent location. Thus, for example, if player A fires a projectile which dislodges a ball from location 78, the ball enters the opposing player's side by moving to the adjacent location 72. In a similar manner, a ball dislodged from location 82 enters the opposing side at location 74. Since projectiles can only be fired along the center, the right, and the left sides of the field 18, the ball can only be dislodged from the locations 78, 82, or 86. If player B were to dislodge the ball from either of the locations 78, 82, or 86, the ball would enter the opposing side at the locations 58, 60, and 62 respectively.

Once the ball is dislodged from the central locations 78, 80, 82, 84 and 86, its subsequent position is indicated by illuminating the appropriate LEDs. Until the ball is intercepted by a player controlled projectile, the ball motion remains under the control of the preprogrammed logic which causes the ball to move in the following manner. If the ball has been dislodged by player A it proceeds into the opposing player side of the field moving along a path that eventually leads to the location on the field 18 closest to the opposing player, in this case location 64 closest to player B. The actual path that the ball traverses is determined in a pseudorandom fashion by the data processing circuitry of the game 10. At each step of the ball motion, the data processing circuitry chooses one of three strategies for moving the ball to the next location, based on a stored probability matrix as described hereinafter. The strategies result in either the ball remaining in the same location, the ball moving sideways, or the ball moving in the direction away from the last projectile which intercepted the ball.

The rate of speed of the ball is a function of the skill level selected at the beginning of the game with higher skill levels resulting in faster ball speed. For example, if the ball is dislodged from location 78 by a projectile fired by player A and moves to position 72, it may next move sideways to location 74, remain in location 72, or may move to location 66, the direction away from player A. The probability of each of these movements occurring is controlled by the data processing circuitry as is discussed hereinafter.

The ball movement strategies described above eventually result in the ball moving to the location closest to the opposing player. When the ball reaches that location (location 64 for player B and location 50 for player A), the ball is effectively taken out of play. The locations 50 and 64 can be thought of as representing pockets through which the ball may be lost. If the ball is permitted to reach either of the pocket locations 64 or 50, the player on the opposite side of the field 18 is awarded a bonus score. Therefore, each player attempts to prevent the ball from reaching his respective pocket location.

A player may change the direction of the ball motion during the game by using the projectiles described above. Thus, in a manner analogous to the method of dislodging the ball from the central row, a player may fire projectiles in an attempt to intercept the ball in its motion toward the pocket location and cause it to move to the opposing player's side of the display 18. If a projectile intercepts the ball, the ball reverses direction. The data processing circuitry recalculates the probabilities of ball motion and causes the ball to move along a path leading away from the pocket location of the player who fired the intercepting projectile.

During game play, the LEDs in the locations 78, 80, 82, 84 and 86 continue to sequentially flash in a cycle as described above. However, once a ball has been dislodged from the central row, lit LEDs at the locations 78, 80, 82, 84 and 86 represent a moving obstacle which operates in the following manner. In order to reach the opposing player's side of the display 18, the ball must cross the central locations 78, 80, 82, 84 and 86. If the ball lands on one of the central locations 78, 80, 82, 84 and 86 at the same time as the moving obstacle, the ball is intercepted and its direction is reversed, placing it in a trajectory back toward the player that last intercepted the ball. Thus, the central row acts as a moving obstacle which when intercepting the ball causes it to move back to the player who is attempting to move the ball to the opposing side.

As an example, if player A launches a projectile toward location 82 by depressing key 32 and the projectile intercepts the ball at location 60, the ball begins to move toward the opposing player's side. Assume the ball moves to location 80 in the central line at the same moment that the moving obstacle is coincident with location 80; instead of proceeding toward player B's side of the display 18, the ball direction is again reversed, returning the ball to the player A side. Thus, player A must again intercept the ball with a projectile in order to move the ball to the opposing player's side. The moving obstacle performs in an analogous manner when player B attempts to move the ball across the barrier to the player A side of the display 18.

To summarize the game play described so far, each player attempts to move the ball from his side of the playing field to the opposing player's side by intercepting the ball with a projectile which may travel along one of three paths. If the ball is not intercepted, it is eventually lost to play when it moves into one of the pocket locations 50 or 64 on the display 18. If this occurs, the central locations 78, 80, 82, 84 and 86 once more indicate a moving ball which must be dislodged by one of the players.

In addition to the game play thus described, each player may capture the ball in the following manner. Each player has a capture position on his side of the playing field display 18. For player A the capture position is location 54, and for player B the capture position is location 68. The players attempt to capture the ball by pressing an appropriate key when the ball is at the designated capture location. By depressing the key 28, player A causes a diamond shaped cluster of lights to be illuminated at locations 60, 52, 50, and 56 around the designated capture location 54. If at this same instant the ball is at location 54, the ball is captured and removed from play. Player A is given a bonus score as described below. Similarly, player B may attempt to capture the ball by depressing the key 36 causing lights at locations 64, 66, 74, and 70 to illuminate around the capture location 68. If the ball is at location 68, it is captured and removed from play and player B is given a bonus score. The effect of removing the ball from play by capture is similar to removing the ball from play by loss in a pocket as described above.

As stated above, the object of the game for a player is to maximize his score before the game ends. The game is completed and the final scores for each player are shown on displays 22 and 24 when five balls have been played. Interim scores are displayed each time a ball is removed from play, either by being captured or by being lost.

The scoring for a player is determined, among other things, by the amount of time the ball remains on the opposing player's side of the field. This amount of time is accumulated by a clock internal to the game 10. The clock is incremented at fixed time intervals, with each interval producing an audible "click" in the speaker 20. The time interval is a function of the skill level of the game, with higher skill levels producing shorter time intervals, corresponding to faster ball speed. The scoring procedure for each player in a preferred embodiment is as follows:

| Event | Score |
|---|---|
| 1. Capturing the Ball | +30points |
| 2. Attempting to Capture the ball and missing | −10points |
| 3. Ball on the Opposing Player's Side of the Field (per time interval or "click") | +3 points |
| 4. Ball Reaches Opposing Player's Pocket location | +30points |
| 5. Firing a Projectile which does not intercept the ball | −1 point |

By providing penalties in the form of negative points for unsuccessful attempts at capturing or intercepting the ball, a higher degree of skill is required to win the game.

In addition to displaying the scores of the respective players, the displays 22 and 24 are also used to inform the players of the number of balls that have been played in the game. As indicated above, when a ball is taken out of play, the scores are displayed at 22 and 24 and the display 18 is blanked. By depressing the upper center key 32 or 40, a player causes the displays 22 and 24 to indicate the next ball number to be played. Depressing the lower key 28 or 36 causes the game to continue and the moving target to be displayed at the locations 78, 80, 82, 84 and 86.

During the game, a variety of sounds are provided from the speaker 20 to indicate events as follows:

| Event | Sound |
|---|---|
| 1. an interval of clock time | click |
| 2. ball is captured | long beep |
| 3. ball is lost in pocket | beep-beep-beep |
| 4. ball intercepted by projectile or moving obstacle | short beep |

Figure 3:
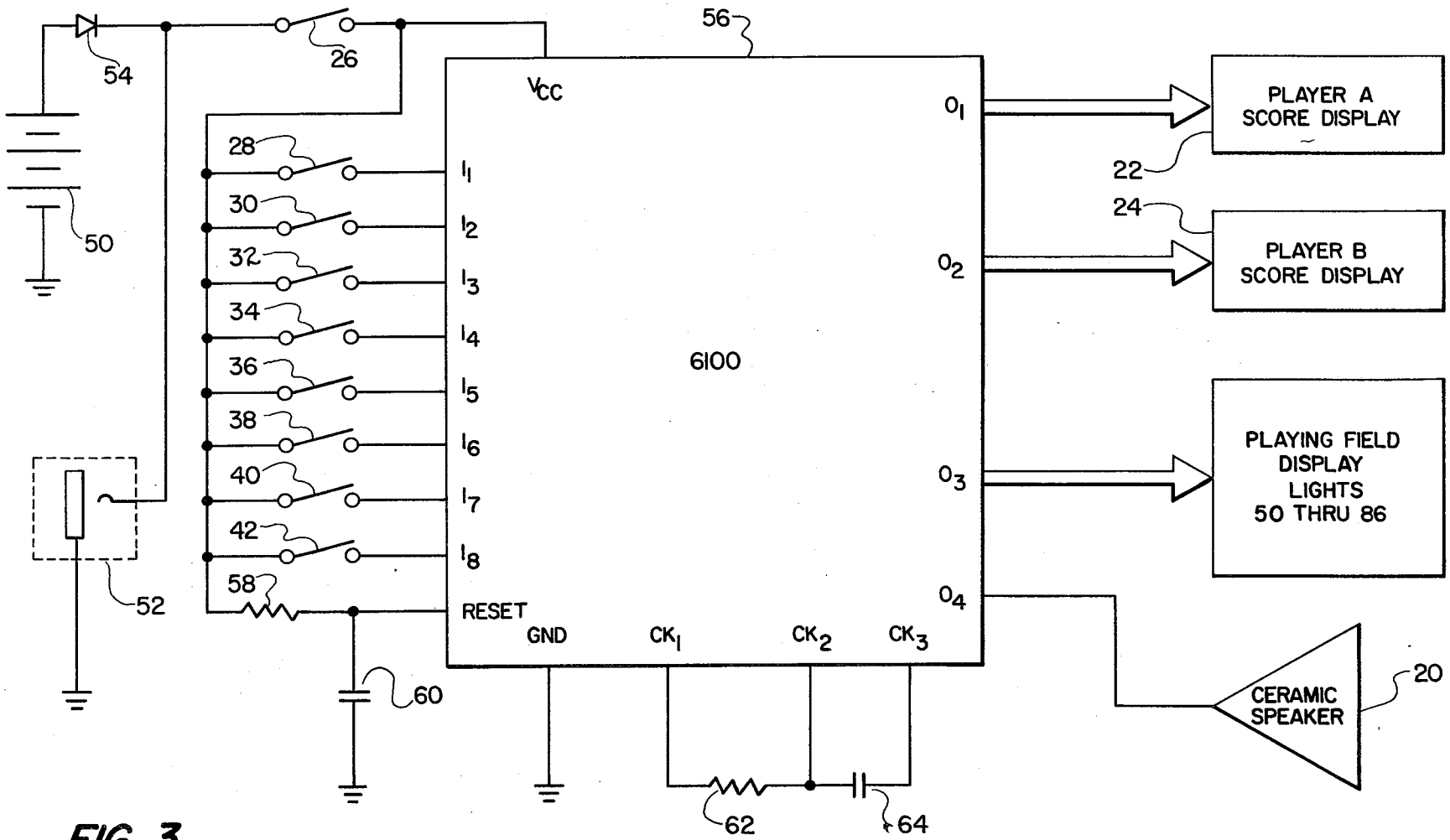
FIG. 3 is a schematic diagram of circuitry utilized in a preferred embodiment of the invention.

Referring now to FIG. 3 there is shown a block diagram of the circuit of the invention. The game 10 is shown in FIG. 3 includes the input keys or switches 28, 30, 32, 34, 36, 38, 40 and 42. Each of the switches 28, 30, 32, 34, 36, 38, 40 and 42 is shown as a normally open switch which upon depression of a button closes a current path. The on/off switch 26 is a single pole slide switch.

Power is furnished to the game 10 from a source of DC power 50 such as a battery which is connected to the switch 26 in parallel with an AC jack 52 which allows house current to be applied through a transformer (not shown). Diode 54 serves to isolate the battery 50 from the AC jack 52. The switch 26 connects power to a controller 56 at the terminals VCC and ground.

As will be understood by those skilled in the art, the controller 56 may be implemented in any number of different ways. However, as with many prior art electronic game circuits, the preferred embodiment of the invention utilizes an integrated circuit microprocessor (a miniature digital electronic computer). Such integrated circuit microprocessors are well known and include all of the input, output, memory, logic and control circuitry of a special purpose digital computer in miniature form. In general, such circuits have both random access memory (RAM memory) and read only memory (ROM memory). The ROM memory has connections formed by masking operations during the construction of the basic circuitry of the controller 56 to provide a completely wired circuit which includes the program for controlling the operation of the microprocessor. Such an arrangement is often described as a dedicated memory circuit. The RAM memory of the circuit is utilized for storage of various transient bits of information and program during the operation of the circuitry.

Various controller circuits are offered by a number of manufacturers and are well known to the prior art. A preferred embodiment of the present invention uses a Rockwell type 6100 microcontroller.

As may be seen in FIG. 3, the closure of the various keys 28, 30, 32, 34, 36, 38, 40 and 42 provide input signals at terminals $I_1$ through $I_8$ of the controller 56. Reset pulses are provided at a reset terminal of controller 56 by reset circuitry including a resistor 58 and a capacitor 60. Timing pulses are provided to the controller 56 at terminals CK1, CK2 and CK3 by an arrangement including a resistor 62 and a capacitor 64.

The controller 56 provides output signals at output ports 01 and 02 to operate the player A score display 22 and the player B score display 24, respectively. These displays are typically three-digit, seven-segment displays as used in calculators. The controller 56 also provides output signals at output port 03 to drive the LED display lights which make up the playing field display 18 shown in FIG. 2. The controller 56 also provides output signals at a terminal 04 for operating a ceramic speaker 20.

The flow charts and tables shown in FIGS. 4–15 describe the overall operation of a preferred embodiment of the game 10 described above.

Figure 4:
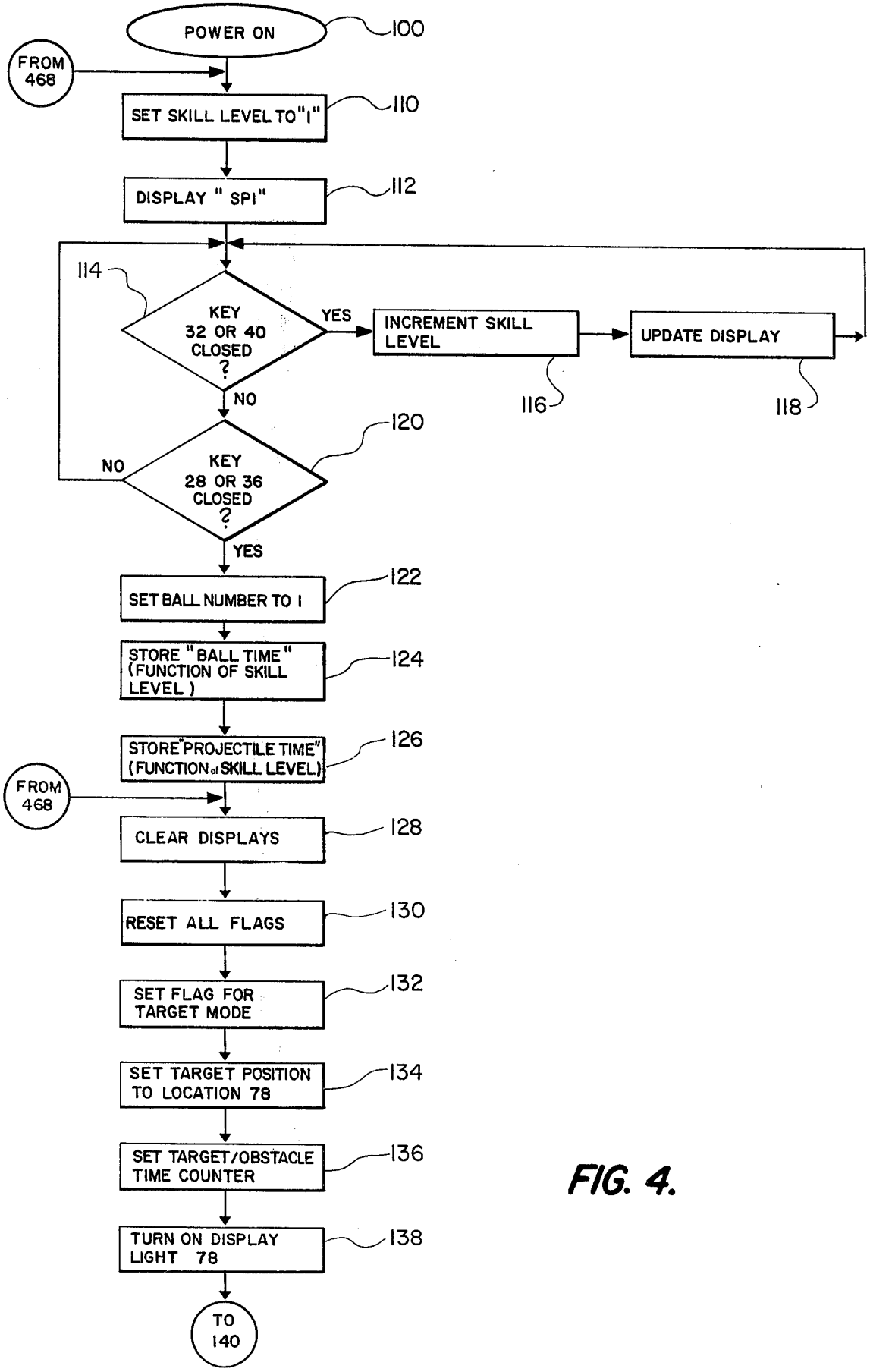

Referring now to FIG. 4, the logic sequence begins at step 100 when the power is applied by closing the switch 26. At steps 110 and 112, the skill level of the game 10 is set at the lowest level and the displays 22 and 24 are caused to show SP1 referring to skill (speed) level one. The program then moves to step 114 to interrogate the keys to determine if key 32 or 40 is closed. Depression of one of these keys 32 or 40 by a player causes the skill level of the game to be incremented at step 116 from SP1 through SP5 in sequence, returning to SP1. The sequencing continues as long as the keys 32 or 40 are depressed. When the players release the keys 32 and 40, the skill level shown in the displays 22 and 24 at step 118 represents the skill level to be used in the game.

The program then moves to interrogate keys 28 and 36 at step 120. When either key 28 or 36 is closed, the program sets the ball number to one at step 122 indicating that this is the first ball to be played in the game. The program then moves to store a ball time and a projectile time at steps 124 and 126. These two variables are a function of the skill level selected and represent the speed at which the ball and the projectiles move during game play. Ball time represents the time interval between the successive click sounds described above. At each click sound, a decision is made by the program to either move the ball from one location to the next or to keep the ball in its present location on the playing field display 18. In like manner, projectile time represents the time interval between successive locations as a projectile moves along its trajectory. The smaller the value of ball time and projectile time, the faster the game play. In the preferred embodiment, the ball time ranges from 0.7 seconds at skill level one to 0.15 seconds at skill level five. Projectile time is approximately one fifth of ball time.

Logic flags are used throughout the program to indicate that various modes have been initiated and also to indicate that various events are in progress. At steps 128 and 130, the program proceeds to reset all flags and to clear the displays 22 and 24. At step 132, the program sets the flag for the target mode indicating that the lights across the center of the display 18 at locations 78, 80, 82, 84 and 86 represent a moving ball target. At step 134, the target position is initialized at location 78. As indicated above, the central locations 78, 80, 82, 84 and 86 represent a ball (target mode) as each new ball is first played; and the locations 78, 80, 82, 84 and 86 represent a moving obstacle (obstacle mode) during subsequent game play. At step 136, the program sets a target/obstacle time counter which represents the interval of time between the successive moves of the lights from one location to the next in either the target or obstacle mode. This time value is the same in either mode and is not a function of skill level. In the preferred emodiment, the typical target/obstacle time interval is 0.7 seconds. The light at location 78 is then turned on at step 138 to initiate the sequence of moving lights across the center of the display 18.

Figure 5:
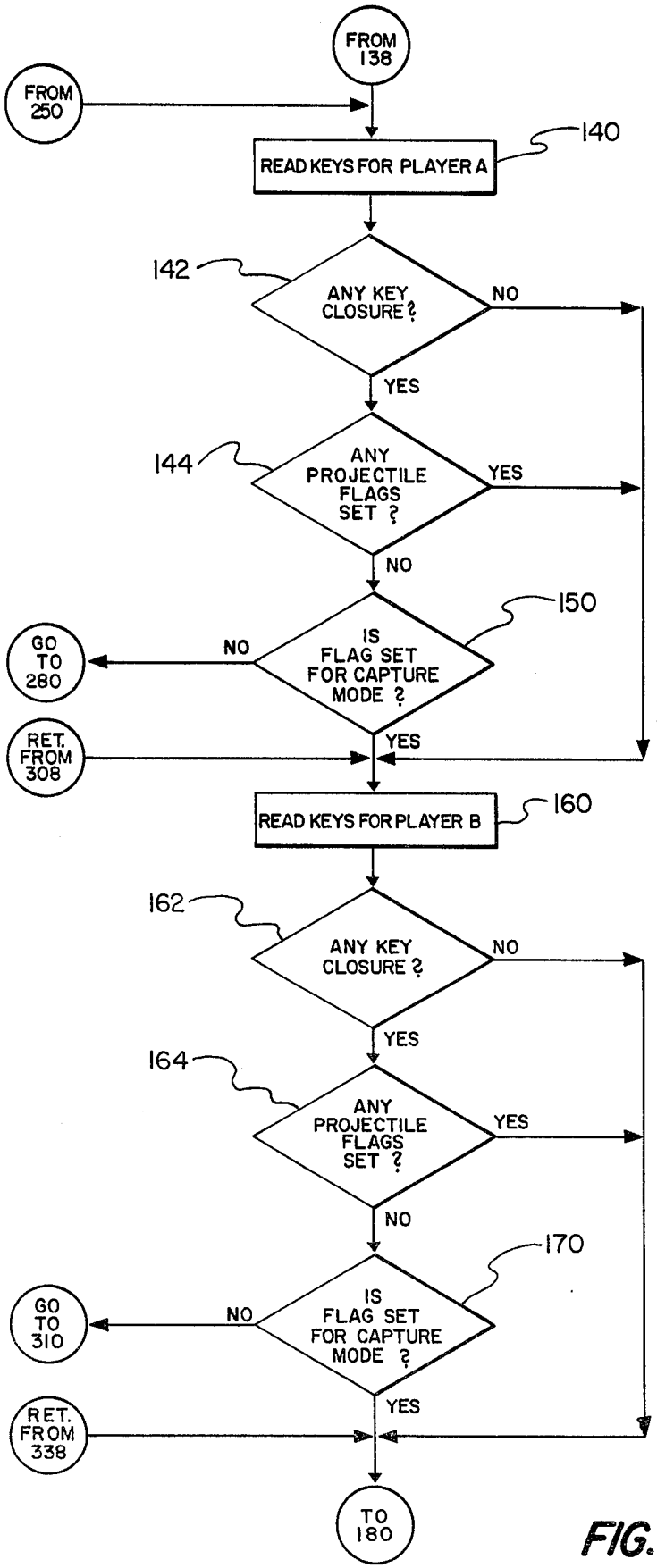

Referring now to FIG. 5, the program moves to steps 140 and 142 to interrogate the keys on the player A side to detect any key closures. If there are no key closures, the program moves to interrogate the keys on the player B side at steps 160 and 162. If there is a key closure, the program moves to steps 142 and 144 and looks to see if any projectile flags or capture mode flags have been set. If a projectile flag is set at step 144, this is indicative of a projectile that is still in motion; and if a capture mode flag is set at step 150, this indicates that the capture mode is still in progress. If either of these conditions exist, the program ignores any subsequent key closures thereby limiting each player to only one projectile or capture mode at a time. Subsequent key closures are ignored until the projectile has completed its flight or the capture mode has been completed. If there are no flags set for the projectiles or the capture mode as detected at steps 144 and 150, the program moves to a subroutine beginning at step 280 in FIG. 6.

The subroutine of FIG. 6 interrogates the keys on the player A side to determine if key 30, 32 or 34 has been closed indicating that a projectile is to be launched. If one of these keys has been depressed as determined at steps 280, 282 and 284, a flag is set at steps 286, 288 and 290 for the appropriate projectile path, on the left, center, or right side relative to the playing field 18. Thus from the player A side, a projectile travels along a left path from location 50 to location 78, along a center path from location 50 to location 82, and along a right path from location 50 to location 86.

Subsequently, at steps 292, 294, and 296 the program sets the time counter for the appropriate projectile path to the variable projectile time as determined by the skill level selected above. The display light at location 50 is then turned on at step 298 to represent the starting point for all projectiles from the player A side, and the projectile position is set at the location 50 at step 300. The program then returns to step 160 in FIG. 5 to continue interrogating the keys on the player B side.

Referring again to FIG. 6 if none of keys 30, 32 or 34 has been closed, key 28 must have been closed on the Player A side to indicate the capture mode. Thus the program moves from step 284 to steps 302 and 304 to set the capture mode flag and the capture mode time counter for the player A side. The capture mode time counter represents the interval of time that the capture mode is left energized after it is initialized by the player. This time interval is fixed and is neither a function of the skill level nor of the length of time that the player depresses a capture mode key 28 or 36. The program then moves to step 306 to turn on display lights at the locations 50, 52, 60, and 56 to form the diamond shape indicative of the capture mode around the position 54 as described above. The program then returns to step 160 to interrogate the keys of the Player B side of the field 18 as shown in FIG. 5.

Figure 7:
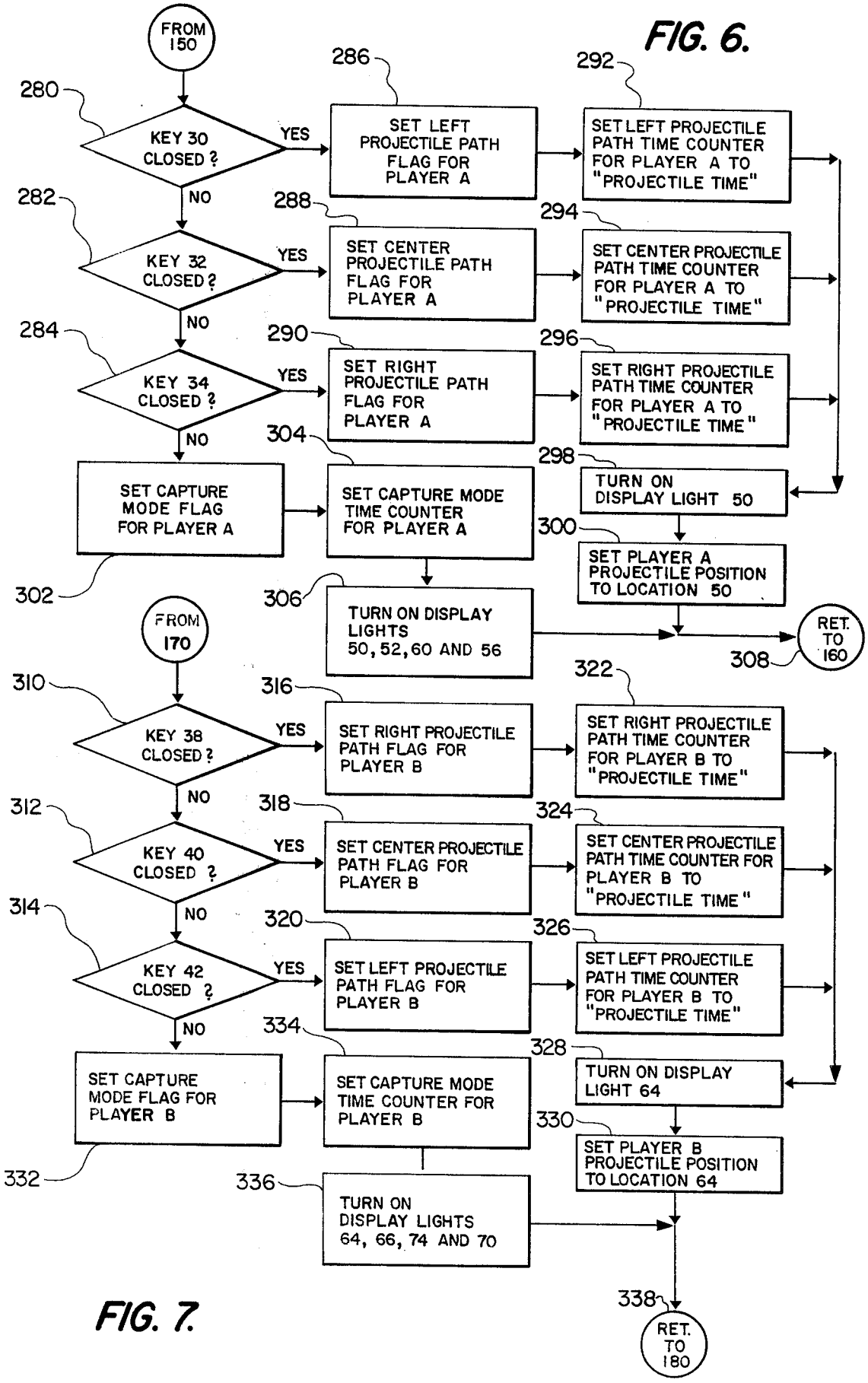

The program in FIG. 5 between steps 160 and 170 is analogous to the program between setps 140 and 150 of FIG. 5 except that the keys on the player B side are interrogated for key closures, subject to whether any projectile or capture mode flags have been previously set. If such a flag has been set, the program moves to the subroutine beginning at step 310 shown in FIG. 7. The subroutine between steps 310 and 338 of FIG. 7 is analogous to the subroutine shown in FIG. 6 and described above. In this case the keys on the player B side are interrogated to determine what action has been requested and the appropriate flags, time counters, and display lights are set. The program then moves to step 180 of FIG. 8.

Figure 8:
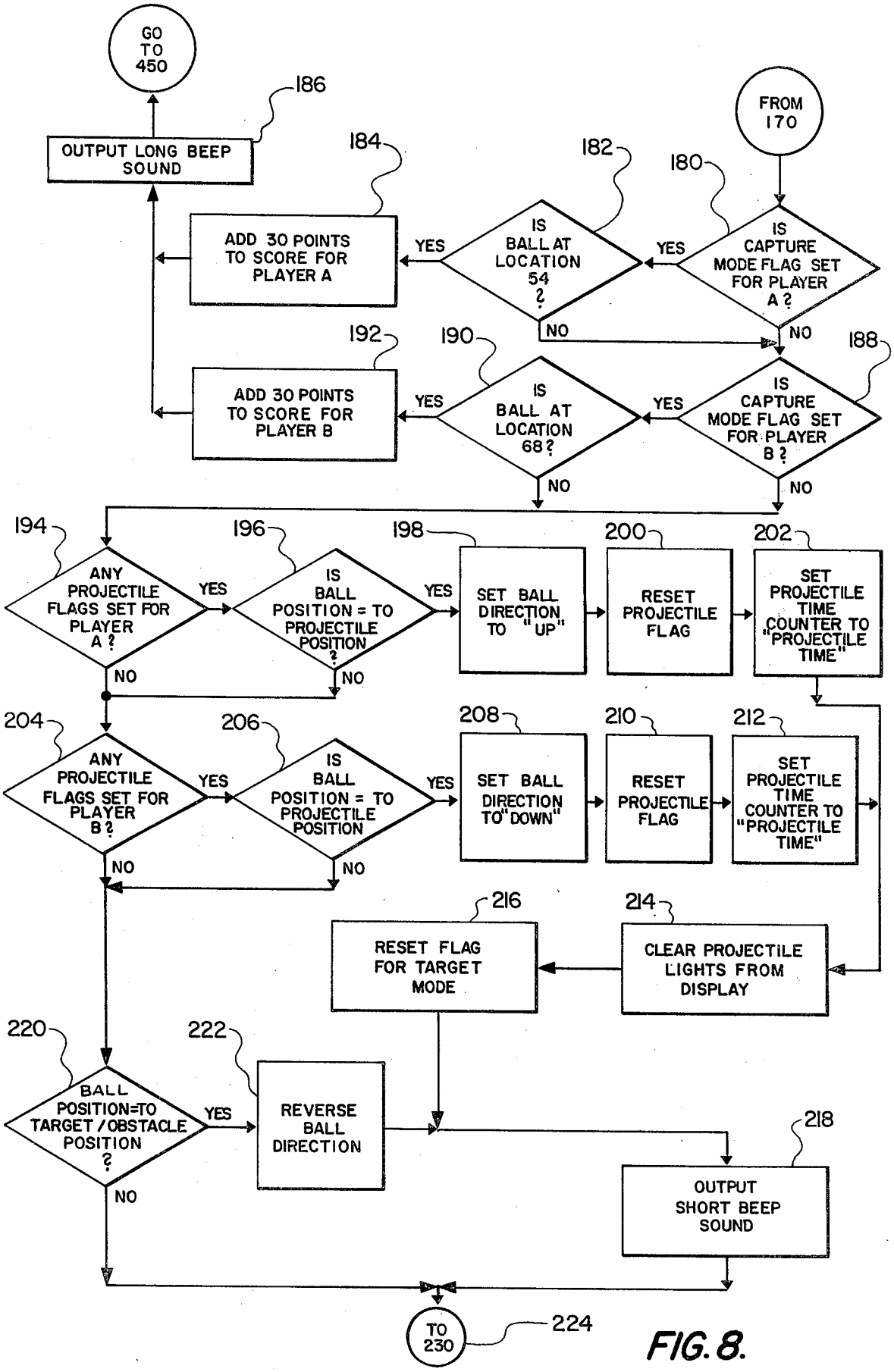

The subroutine between steps 180 and 224 of FIG. 8 is used to determine whether there has been a collision between the ball and either a projectile, a target, or an obstacle. At step 180 in FIG. 8, the program moves to determine if a capture mode is in progress and if it has been successful in capturing the ball. If the capture mode flag is set for player A indicating the capture mode has been initiated and if the ball is at the designated capture location 54, the score for player A is increased by 30 points at step 184. The program then outputs a long beep sound at step 186 to indicate a successful capture. In a similar fashion, the program at steps 188 and 190 determines whether a capture has occurred on the player B side which requires the ball to be at location 68. If this should occur, the program adds 30 points to the score for player B at step 192 and again outpus a long beep sound at step 186. The program then moves to the subroutine beginning at step 450 in FIG. 11 to initiate the play of a new ball.

Still referring to FIG. 8, if the ball has not been captured, the program moves to step 194 to determine if a projectile has collided with the ball. At steps 194, 196 and 198 if a projectile flag is set for player A and if the ball position is equal to the projectile position indicating a collision, the ball direction is set to "up." As used in this context, up means a ball direction which moves from player A to player B as shown in FIG. 2; and "down" means ball direction moving from player B to player A. Thus if a projectile collides with the ball, the logic is such that the ball will be programmed to move in a direction away from the projectile. The program moves on to reset the projectile flag at step 200 to indicate that the projectile has been terminated after collision. The projectile time counter is again set to projectile time at step 202 reinstating the counter for the next projectile command.

In like fashion, at steps 204 and 206 in FIG. 8 the program determines whether a projectile has been launched by player B and if a collision has occurred. If so, the ball direction is set to down and once again the appropriate projectile flag is reset at steps 208, 210 and 212. When a collision occurs, the projectile lights are cleared from the display, the target mode flag is reset, and a short beep is sounded at steps 214, 216 and 218. The program then moves on to step 230 shown in FIG. 9.

The subroutine in FIG. 8 also tests for a collision between the ball and the moving obstacles at program step 220. If such a collision has occurred, the ball direction is reversed at step 222, causing the ball to move back in the direction from which it came. The program outputs a short beep sound and moves to step 230 shown in FIG. 9.

Figure 9:
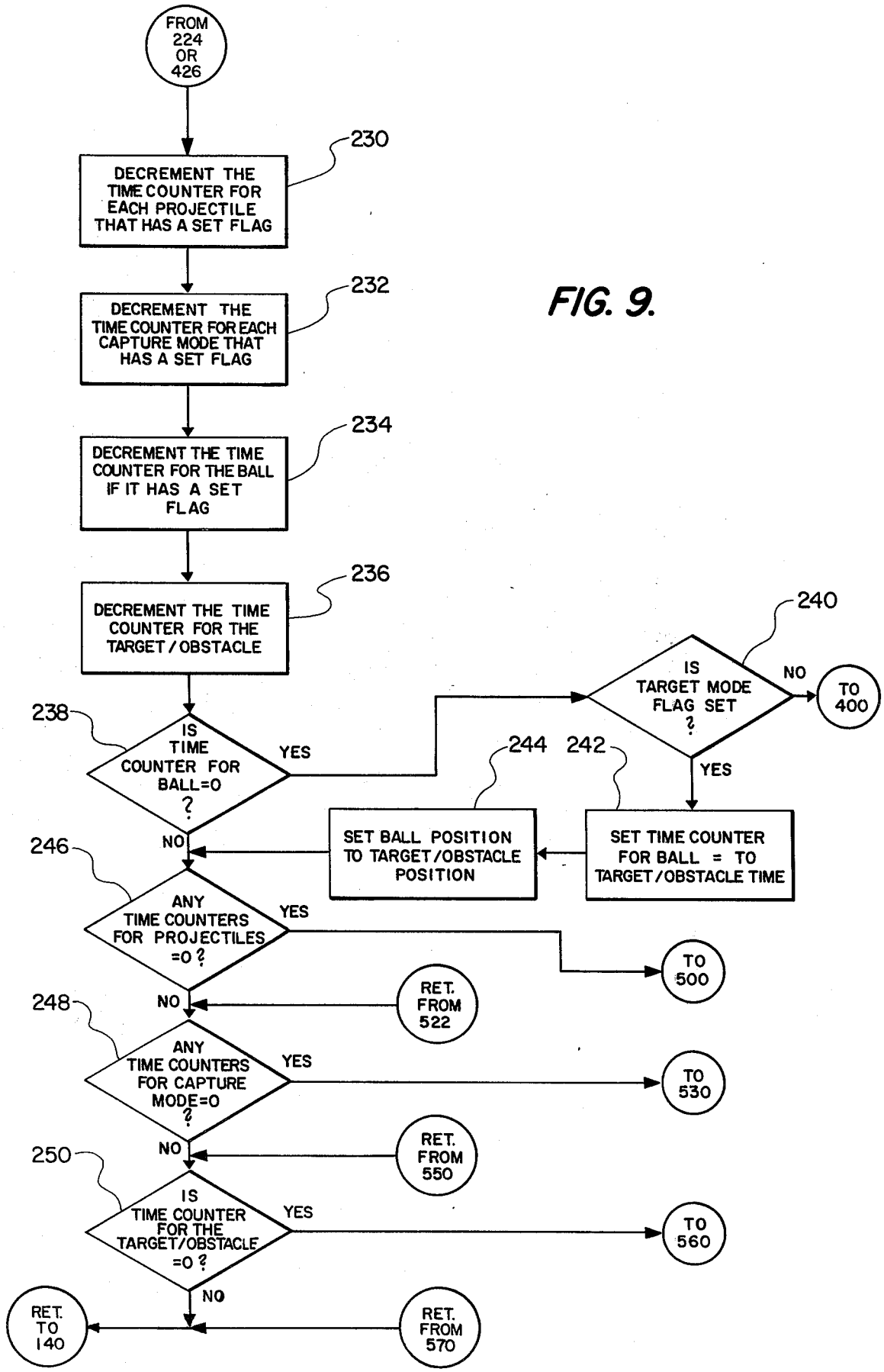

Steps 230, 232, 234 and 236 of the program shown in FIG. 9 are used to decrement the time counters for each event that is in progress, (an event in progress being indicated by having a set flag). The operation of the time counters in the program is as follows. A separate time counter is provided for each projectile path, for each capture mode, for the ball and for the target/obstacle. The purpose of each time counter is to determine when the next move is to occur. Each time counter is initially set with a value of time corresponding to the speed of motion of the particular item. The shorter the time the faster the speed of motion. For each cycle of the program through its logic steps, the time counter for each event in progress is decremented at a fixed time interval. Each clock time interval is a function of, among other things, the internal clock rate of the controller 56. After several successive passes of the program through its logic sequence, each time counter is eventually decremented to zero. At this point, the program moves the particular item to its new position, the time counter is again set to the applicable initial time value for that item, and the decrementing procedure begins again. In the flow chart of FIG. 9, steps 230, 232 and 234 decrement the appropriate time counters for the projectile paths, the capture mode, and the ball. These time counters are decremented only when the corresponding event has been initiated. Although most event initiations are indicated by a set flag for that particular event, the target/obstacle time counter is decremented at step 236 for each pass through the program without the requirement for a set flag.

As described above, the target/obstacle is represented by a sequence of lights across the center of the playing field display 18. This sequence is initiated at the beginning of game play, continues until the end of game play, and is not under player control. Steps 238, 246, 248 and 250 shown in FIG. 9 perform the functions of interrogating the time counters of the ball, the projectile, the capture mode, and the target/obstacle to determine if any of these counters have reached zero. As indicated above, when a time counter has been decremented to zero the position of the corresponding item is updated.

At step 238 of the program, if the time counter for the ball has been decremented to zero, the program moves to step 240. If the game is still in the target mode, at step 242 the ball time counter is set equal to the target/obstacle time, and at step 244 the ball position is set equal to the target/obstacle position.

Figure 10:
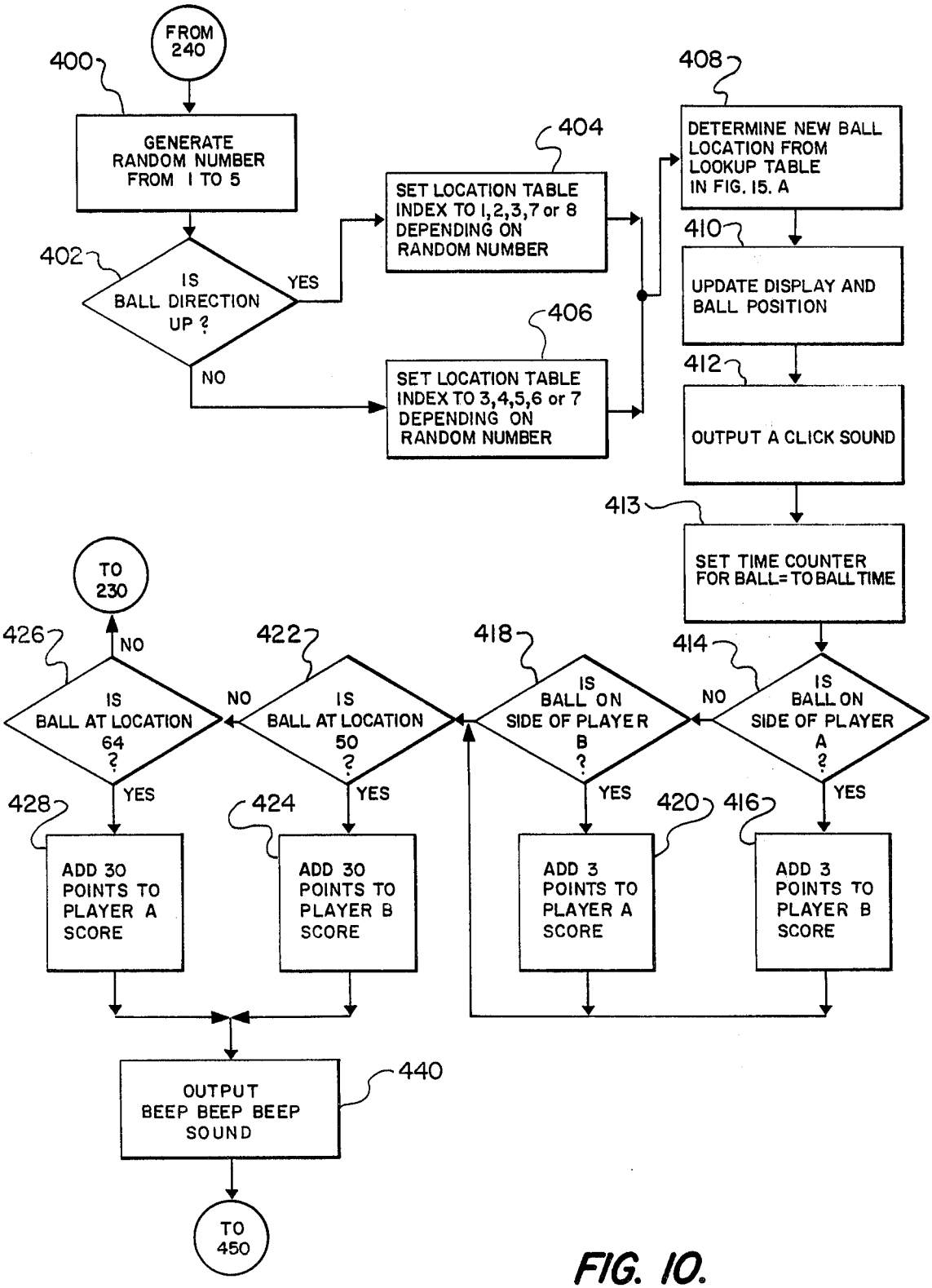

If at step 240 the target mode flag was not set indicating that the target mode was not active and that the ball had previously been placed into play, the program moves to determine the motion of the ball at step 400 shown in FIG. 10.

The flow chart shown in FIG. 10 in conjunction with the lookup table shown in FIG. 15A is used to determine the motion of the ball in the following manner. At step 400, the program generates a psuedorandom number from one to five. At step 402 the program branches depending on whether ball direction has been set to up or down, as described above. Using the random number, the program moves to step 404 or 406 to determine an index used in finding the new position of the ball. The indices at step 404 is used if the ball direction is up and the indices at step 406 is used when the ball direction is down.

Thus at step 404 an index number of either one, two, three, seven or eight is chosen based on whether a random number of one, two, three, four or five, respectively, has been generated at step 400. Similarly, at step 406 an index number of either three, four, five, six or seven is chosen based on whether a random number of one, two, three, four or five, respectively has been generated at step 400. The purpose of the index is to determine an entry point into the ball location lookup table shown in FIG. 15A. Given the present location of the ball and the index number, the table in FIG. 15A is used to determine the new location of the ball at step 408.

The lookup table in FIG. 15A has been generated based on a probability matrix for motion of the ball. This probability matrix is summarized in FIG. 15B where, given the present location of the ball and the direction of the ball (either up or down) the probability of the direction for the next move is shown. As an example, if the present location of the ball is at a pocket location 50 or 64, the ball is not moved in any direction. Thus there is a 100% probability that regardless of ball direction the ball will not move from these locations, as shown in FIG. 15B. This can be seen in the lookup table of FIG. 15A where it is shown that regardless of the random number generated, if the present location of the ball is in either location 50 or 64, the new location is the same.

As another example, if the present location of the ball is at location 60 and the present ball direction is up, from FIG. 15B the probability of the next move being up is 20%, the probability of the next move being to the left is 40%, and the probability of the next move being to the right is 40%. Similarly, if the present ball direction is down there is a 20% probability that the next move will be down, a 40% chance that the next move will be to the left, and a 40% chance that the next move will be to the right. These probabilities as shown in FIG. 15B are translated into entries in the lookup table of FIG. 15A as follows.

Since the program generates random numbers from one to five, the probability of generating each number is 20%. Accordingly, the probability of choosing any one of the index numbers is also 20%. Refer now to FIG. 15A under the column for present ball location 60. For each column in FIG. 15A there are five entries corresponding to the up indices one, two, three, seven and eight and five entries corresponding to the down indices three, four, five, six and seven. Referring now to the five down entries there appears a single entry for new location 54, corresponding to index number four. Referring to FIG. 2, location 54 represents a down move from location 60. Since location 54 only appears once for the down entries in the column 60 of FIG. 15A, there is one chance out of five or a 20% probability that the move will be in a down direction. Similarly, there are two entries at indices five and seven for a new location 58 which represents a move to the left. There are also two entries at indices three and six for a new location 62 which represents a move to the right. For each of these sideways moves there is a two out of five or a 40% probability of occurrence. A similar analysis of FIG. 15A using the five up index entries under the column for present location 60 will yield the same probabilities as indicated in FIG. 15B. Thus by storing the index tables of steps 404 and 406 and the lookup table of FIG. 15A in the memory of the controller 56, the movement of the ball follows the probability matrix generated in FIG. 15B.

Returning now to the flow chart of FIG. 10, after the new ball location has been determined from the lookup table in FIG. 15A, the display on playing field 18 is updated at step 410 by turning on the appropriate light to show the new location of the ball. The program also outputs a click sound at step 412 to indicate one clock time interval has passed. The time counter for the ball is again set to ball time at step 413.

The next move at step 414 is to determine on which side of the playing field 18 the ball is located. If it is on the player A side, three points are added to the score for player B at step 416 in accordance with the scoring procedure indicated above. In like fashion if the ball is on the player B side, three points are added to the score for player A at steps 418 and 420. The program then determines if the ball is in either of the pocket locations 54 or 64 at steps 422 and 426. If the ball is at location 50, the pocket for player A, 30 points are added to the score for player B at step 424 and the controller initiates a beep-beep-beep sound at step 440 to indicate a lost ball. In a similar fashion if the ball is at location 64, the pocket location for player B, 30 points are added to the player A score at step 428 and, again, the beep-beep-beep sound is made. The program then moves to a subroutine in FIG. 11 starting with step 450 to initiate a new ball. If the ball has not been lost, the program moves from step 420 back to the main routine at step 230 in FIG. 9.

Figure 11:
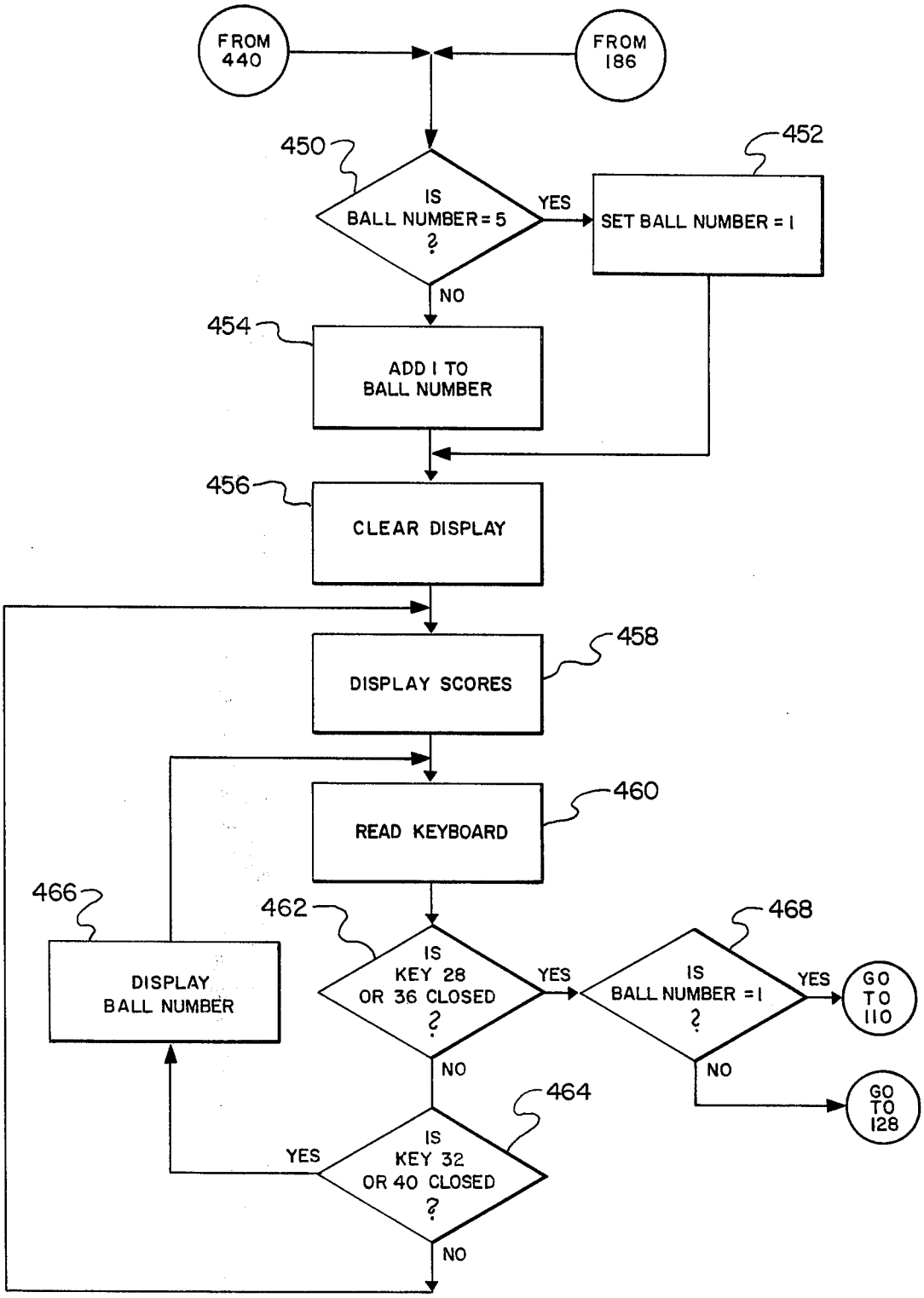

Referring now to the subroutine shown in FIG. 11 between steps 450 and 468, this routine is used to intiate a new ball and to reinstitute game play. As indicated above, this routine may be entered by having the ball captured at step 186 or lost at step 440. At step 450 of FIG. 11, the program determines whether the last ball in the game (ball number five) has been played. If the ball number is five, the program resets the ball number to one at step 452 and proceeds to step 456. If ball number five has not been played, the ball number is incremented by one at step 454, the display is cleared at step 456, and the scores are shown in the three digit displays 22 and 24 for each player at step 458. The program then reads the keys at steps 460 and 462 to see if key 28 or 36 is closed. If key 28 or 36 is closed and if the ball number is equal to one indicating a new game, the program returns from step 468 to step 110 shown in FIG. 4 and starts the entire game from the beginning. If the ball number is not one indicating the next ball to be played is in the same game, the program returns to step 128 shown in FIG. 4. Beginning at step 128, the display is cleared, the flags are reset, and the game reverts to the target mode.

The subroutine of FIG. 11 also interrogates the keys at step 464 to see if key 32 or 40 is depressed. If either of these keys are depressed, the displays 22 and 24 show the next ball number to be played at step 466.

Referring back to FIG. 10, if the ball has not been removed from play by either capture or loss, the program returns from step 426 to the main routine at step 230 shown in FIG. 9. As described above, steps 230, 232, 234 and 236 decrement the time counters for the game 10. Since the ball time counter was set to ball time at step 413 in FIG. 10, the program moves to step 426 in FIG. 9.

At step 246 in FIG. 9 it is determined whether any time counters for the projectile's path are equal to zero indicating that it is time to update the position of the projectile. If updating is required, the program moves to a subroutine beginning at step 500 in FIG. 12. Steps 500 and 508 determine if the projectiles have moved all four positions to the end of their travel at the center of the playing field display 18. If a projectile has moved four positions which indicates it has completed its trajectory without intercepting the ball, one point is subtracted from the player A score for a player A projectile at step 502 and one point is subtracted from player B score for a player B projectile at step 510. In either case, the appropriate projectile flag is reset at steps 504 and 512 to indicate the projectile is no longer in play. At steps 506 and 514, the indicator lights for the projectile are cleared from the display. If the projectile has not moved four positions, it is advanced to its next position at step 516. The program stores the new projectile location and updates the display by turning on the appropriate indicator light at steps 518 and 520. The time counters for the projectile are again set to the projectile time at step 522 and the program returns to the main routine at step 248 in FIG. 9.

Step 248 determines whether any time counters for the capture mode are equal to zero. If this is the case, the program moves to a subroutine beginning with step 530 shown in FIG. 13. Step 530 determines whether the capture mode has been initiated by player A or player B. If the program enters the subroutine in FIG. 13, it indicates that the ball was not captured since a successful capture terminates game play at step 186 shown in FIG. 8. The subroutine of FIG. 13 subtracts ten points from the score of the player who initiated the unsuccessful capture mode at steps 532 and 534. The appropriate capture mode flag is reset indicating that the mode is complete, the cluster of capture mode lights is turned off, and the appropriate capture mode time counter is set at steps 536, 538, and 550. The program then returns from step 550 to the main program at step 250 shown in FIG. 9.

Step 250 in FIG. 9 determines whether the time counter for the target/obstacle is equal to zero which indicates that it is time to update the position of the target/obstacle. If this is the case, the program moves to the subroutine beginning at step 560 shown in FIG. 14. At this step, the time counter is again set for the target/obstacle and the position is advanced at step 562. The new location is stored and the display lights are updated at steps 564 and 570. As indicated above, the target/obstacle consists of a moving light whose location moves across the middle of the playing field display 18 progressing from position 78 to position 86 and then returning from position 86 directly back to position 78. The subroutine of FIG. 14 returns from step 570 to the main program at step 140 shown in FIG. 5. This completes program loop as step 140 again interrogates the keys for additional players entries.

As will be understood by those skilled in the art, many different programs may be utilized to implement the flow charts disclosed in this specification. Obviously, those programs will vary from one another in different degrees. However, it is well within the skill of the art of the computer programmer to provide particular programs for implementing each of the steps of the flow charts disclosed herein. It is also to be understood that various microcomputer circuits might be programmed for implementing each of the steps of the flow charts disclosed herein without departing from the teachings of the invention. It is therefore to be understood that various other embodiments may be devised by those skilled in the art without departing from the spirit and scope of the invention. It is thus the intention of the inventors to be limited only by the scope of the claims appended hereto.

What is claimed is:

1. An electronic game comprising:

a display including first, second and third sets of indicia;

input means responsive to commands from a player;

first control means responsive to the input means for causing the first set of indicia to represent a first moving projectile;

second control means responsive to the input means for causing the second set of indicia to represent a second moving projectile;

third control means responsive to the input means for causing the third set of indicia to represent a moving target;

first detection means for detecting a collision between either the first or second projectile and the moving target;

fourth control means responsive to the first detection means for causing the third set of indicia to represent a moving obstacle; and fifth control means responsive to the first detection means for causing either the first or second set of indicia to represent a moving ball.

2. The electronic game of claim 1 further including:

means for designating a predetermined indicium in the first set of indicia and a predetermined indicium in the second set of indicia as pocket positions; and first ball removal means for removing the ball from play whenever it moves to one of the pocket positions.

3. The electronic game of claim 2 further including:

second input means for temporarily causing a particular indicium in the first set of indicia to be designated as a first capture position;

third input means for temporarily causing a particular indicium in the second set of indicia to be designated as a second capture position;

second detection means for detecting; whether the ball is at either the first or second capture positions; and second ball removal means responsive to the second and third input means and the second detection means for removing the ball from play whenever the ball is at an indicium when it is designated as a capture position.

4. The electronic game of claim 3 in which the third control means is further responsive to both the first and second ball removal means to cause the third set of indicia to represent the moving ball whenever the ball is removed from play.

5. The electronic game of claim 3 including:

means for assigning the first set of indicia to a first player;

means for assigning the second set of indicia to a second player; and scoring means comprising means for increasing the score of a respective one of the players in an amount proportional to the duration of time in which the ball appears on the indicia assigned to the other of the players.

6. The electronic game of claim 5 in which the scoring means further includes:

means for decreasing the score of the first player if the second input means is activated and if the second detector means does not detect that the ball is at the first capture position; and means for decreasing the score of the second player if the third input means is activated and if the second detector means does not detect that the ball is at the second capture position.

7. The electronic game of claim 1 in which the fifth control means includes pseudorandom means for determining whether the ball should move or should remain stationary, and for determining in which direction, if any, the ball should move.

* * * * *